US011628495B2

(12) United States Patent
Yoo et al.

(10) Patent No.: US 11,628,495 B2
(45) Date of Patent: Apr. 18, 2023

(54) METHOD FOR MANUFACTURING METAL FOAM

(71) Applicant: LG CHEM, LTD., Seoul (KR)

(72) Inventors: Dong Woo Yoo, Daejeon (KR); Jin Kyu Lee, Daejeon (KR); Jong Min Shin, Daejeon (KR)

(73) Assignee: LG CHEM, LTD., Seoul (KR)

( * ) Notice: Subject to any disclaimer, the term of this patent is extended or adjusted under 35 U.S.C. 154(b) by 460 days.

(21) Appl. No.: 16/347,059

(22) PCT Filed: Nov. 29, 2017

(86) PCT No.: PCT/KR2017/013732
§ 371 (c)(1),
(2) Date: May 2, 2019

(87) PCT Pub. No.: WO2018/101714
PCT Pub. Date: Jun. 7, 2018

(65) Prior Publication Data

US 2020/0070248 A1 Mar. 5, 2020

(30) Foreign Application Priority Data

Nov. 30, 2016 (KR) ..... 10-2016-0162153

(51) Int. Cl.
*B22F 3/105* (2006.01)
*B22F 3/11* (2006.01)
(Continued)

(52) U.S. Cl.
CPC ..... *B22F 3/105* (2013.01); *B22F 1/10* (2022.01); *B22F 1/107* (2022.01); *B22F 3/1125* (2013.01);
(Continued)

(58) Field of Classification Search
CPC ..... H01M 4/762; H01M 4/80; H01M 4/8605; H01M 4/861; H01M 4/8636;
(Continued)

(56) References Cited

U.S. PATENT DOCUMENTS 5,848,351 A * 12/1998 Hoshino ..... H01M 4/742 428/550
6,166,360 A * 12/2000 Ruffini, Sr. ..... C21D 9/0068 219/601
(Continued)

FOREIGN PATENT DOCUMENTS

DE 3015981 A1 * 11/1981 ..... H01M 4/26
EP 765704 A2 * 4/1997 ..... B01D 39/2051
(Continued)

OTHER PUBLICATIONS

Peter A. Hassell and Nicholas V. Ross, "Induction Heat Treating of Steel," ASM Handbooks (online), vol. 4, 2002, 55 pages total. (Year: 2002).*
(Continued)

*Primary Examiner* — Vanessa T. Luk
(74) *Attorney, Agent, or Firm* — Myers Bigel, P.A.

(57) ABSTRACT

The present application provides a method for manufacturing a metal foam. The present application can provide a method for manufacturing a metal foam, which is capable of forming a metal foam comprising uniformly formed pores and having excellent mechanical properties as well as the desired porosity, and a metal foam having the above characteristics. In addition, the present application can provide a method capable of forming a metal foam in which the above-mentioned physical properties are ensured, while being in the form of a thin film or sheet, within a fast process time, and such a metal foam.

20 Claims, 2 Drawing Sheets

(51) Int. Cl.
*B22F 5/00* (2006.01)
*B22F 1/107* (2022.01)
*B22F 1/10* (2022.01)

(52) U.S. Cl.
CPC ..... *B22F 5/006* (2013.01); *B22F 2003/1053* (2013.01); *B22F 2304/10* (2013.01)

(58) Field of Classification Search
CPC ..... H01M 4/8642; H01M 2004/021; H01M 8/023; H01M 8/0232; H01M 8/0234; H01M 8/0236; H01M 8/0239; H01M 8/0241; H01M 8/0243; H01M 8/0245; H01M 8/1079; H01M 8/1058; H01M 8/106; H01M 8/1062; H01M 8/1067; H01M 50/491; C22C 1/0433; C22C 1/0441; C22C 1/08; C22C 2001/081; C22C 2001/082; C22C 2001/083; C22C 2001/085; C22C 2001/086; C22C 2001/087; C22C 2001/088; B22F 1/0059; B22F 1/0062; B22F 1/0074; B22F 1/0077; B22F 2001/0066; B22F 3/10; B22F 3/11; B22F 3/1103; B22F 3/1109; B22F 3/1112; B22F 3/1115; B22F 3/1118; B22F 3/1121; B22F 3/1125; B22F 3/1134; B22F 3/1137; B22F 3/114; B22F 3/1143; B22F 3/1146; B22F 3/105; B22F 2003/1106; B22F 2003/1128; B22F 2003/1131; B22F 2003/1051; B22F 2003/1052; B22F 2003/1053; B22F 2003/1054; B22F 5/006; B22F 7/002; B22F 7/004; B22F 7/006; B22F 2202/05; B22F 2202/06; B22F 2301/15; B22F 2301/155; B22F 2301/35; B22F 2301/355; B22F 2207/17; C21D 1/10; C21D 1/42; C21D 9/60
USPC ..... 219/600–677
See application file for complete search history.

(56) References Cited

U.S. PATENT DOCUMENTS

| | | | | |
|---|---|---|---|---|
| 2007/0099020 | A1 | 5/2007 | Karl et al. | |
| 2014/0182808 | A1 | 7/2014 | Choi et al. | |
| 2015/0334781 | A1* | 11/2015 | Verhagen | C21D 1/42 219/667 |

FOREIGN PATENT DOCUMENTS

| | | |
|---|---|---|
| JP | H02254106 | 10/1990 |
| JP | H05339605 | 12/1993 |
| JP | H06287608 | 10/1994 |
| JP | 1997087705 | 3/1997 |
| JP | 2004047126 | 2/2004 |
| JP | 2005290494 | 10/2005 |
| JP | 2009102701 | 5/2009 |
| JP | 2011111644 | 6/2011 |
| KR | 1020080044344 | 5/2008 |
| KR | 100958920 | 5/2010 |
| KR | 101056615 | 8/2011 |

OTHER PUBLICATIONS

Achenbach, Paul R., "General Construction Principles," Ch. 15, Moisture Control in Buildings, ASTM, 1994, pp. 283-290. (Year: 1994).*

International Search Report corresponding to International Patent Application No. PCT/KR2017/013732, dated Mar. 12, 2018. (5 pages with English translation).

Extended European Search Report corresponding to EP 17875868.6, dated Sep. 12, 2019 (7 pp).

* cited by examiner

[Figure 1]
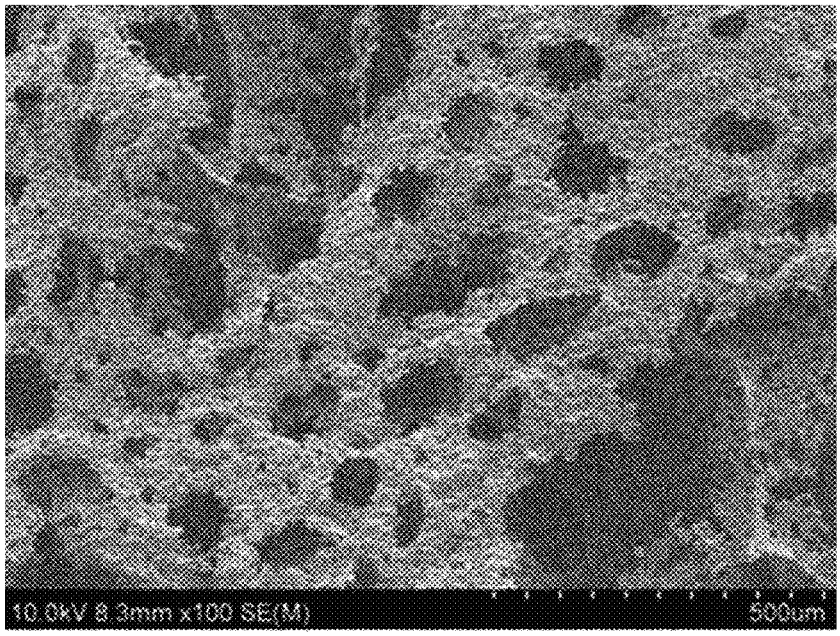
[Figure 2]
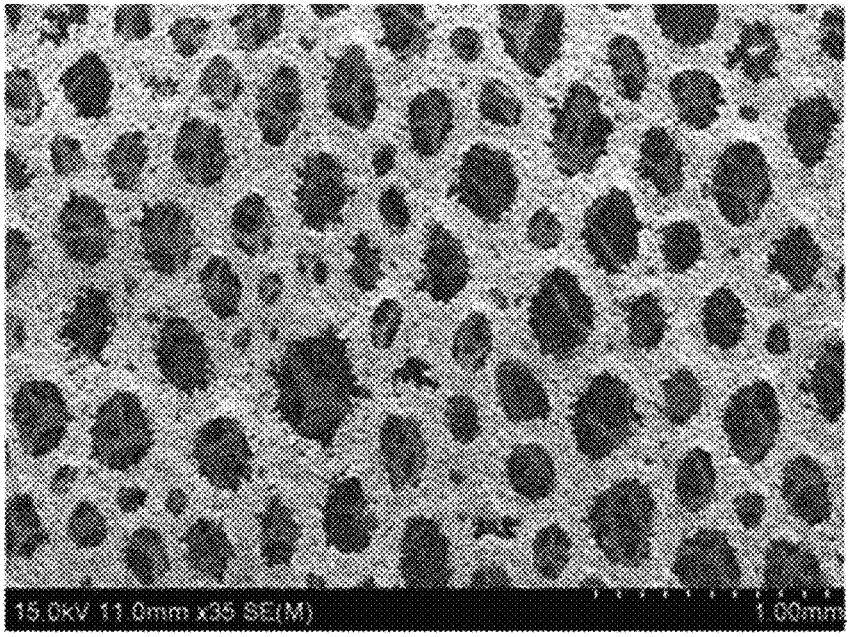

[Figure 3]
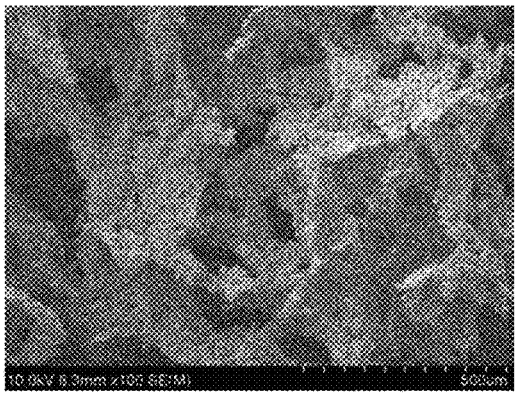

METHOD FOR MANUFACTURING METAL FOAM

CROSS REFERENCE TO RELATED APPLICATIONS

This application is a 35 U.S.C. § 371 national stage application of PCT International Application No. PCT/KR2017/013732, filed Nov. 29, 2017, which claims priority from Korean Patent Application No. 10-2016-0162153, filed Nov. 30, 2016, the contents of which are incorporated herein in their entireties by reference. The above-referenced PCT International Application was published in the Korean language as International Publication No. WO 2018/101714 A1 on Jun. 7, 2018.

TECHNICAL FIELD

The present application relates to a method for manufacturing a metal foam and a metal foam.

BACKGROUND ART

Metal foams can be applied to various fields including lightweight structures, transportation machines, building materials or energy absorbing devices, and the like by having various and useful properties such as lightweight properties, energy absorbing properties, heat insulating properties, refractoriness or environment-friendliness. In addition, metal foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is an object of the present invention to provide a method capable of manufacturing a metal foam comprising pores uniformly formed and having excellent mechanical strength as well as a desired porosity.

Technical Solution

In the present application, the term metal foam or metal skeleton means a porous structure comprising two or more metals as a main component. Here, the metal as a main component means that the proportion of the metal is 55 wt % or more, 60 wt % or more, 65 wt % or more, 70 wt % or more, 75 wt % or more, 80 wt % or more, 85 wt % or more, 90 wt % or more, or 95 wt % or more based on the total weight of the metal foam or the metal skeleton. The upper limit of the proportion of the metal contained as the main component is not particularly limited and may be, for example, 100 wt %.

The term porous property may mean a case where porosity is 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. Here, the porosity can be calculated in a known manner by calculating the density of the metal foam or the like.

The method for manufacturing a metal foam of the present application may comprise a step of sintering a green structure comprising a metal component having metals. In the present application, the term green structure means a structure before the process performed to form the metal foam, such as the sintering process, that is, a structure before the metal foam is formed. In addition, even when the green structure is referred to as a porous green structure, the structure is not necessarily porous per se, and may be referred to as a porous green structure for convenience, if it can finally form a metal foam, which is a porous metal structure.

In the present application, the green structure may be formed using a slurry containing at least a metal component, and first and second solvents.

In one example, the metal component may comprise at least a metal having appropriate relative magnetic permeability and conductivity. According to one example of the present application, the application of such a metal can ensure that when an induction heating method to be described below is applied as the sintering, the sintering according to the relevant method is smoothly carried out.

For example, as the metal, a metal having a relative magnetic permeability of 90 or more may be used. Here, the relative magnetic permeability ($\mu_r$) is a ratio ($\mu/\mu_0$) of the magnetic permeability ($\mu$) of the relevant material to the magnetic permeability ($\mu_0$) in the vacuum. The metal used in the present application may have a relative magnetic permeability of 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The upper limit of the relative magnetic permeability is not particularly limited because the higher the value is, the higher the heat is generated when the electromagnetic field for induction heating as described below is applied. In one example, the upper limit of the relative magnetic permeability may be, for example, about 300,000 or less.

The metal may be a conductive metal. In the present application, the term conductive metal may mean a metal having a conductivity at 20° C. of about 8 MS/m or more, 9 MS/m or more, 10 MS/m or more, 11 MS/m or more, 12 MS/m or more, 13 MS/m or more, or 14.5 MS/m, or an alloy thereof. The upper limit of the conductivity is not particularly limited, and for example, may be about 30 MS/m or less, 25 MS/m or less, or 20 MS/m or less.

In the present application, the metal having the relative magnetic permeability and conductivity as above may also be simply referred to as a conductive magnetic metal.

By applying the conductive magnetic metal, sintering can be more effectively performed when the induction heating process to be described below proceeds. Such a metal can be exemplified by nickel, iron or cobalt, and the like, but is not limited thereto.

The metal component may comprise, if necessary, a second metal different from the conductive magnetic metal together with the metal. In this case, the metal foam may be formed of a metal alloy. As the second metal, a metal having the relative magnetic permeability and/or conductivity in the same range as the above-mentioned conductive magnetic metal may also be used, and a metal having the relative magnetic permeability and/or conductivity outside the range may be used. In addition, the second metal may also comprise one or two or more metals. The kind of the second metal is not particularly limited as long as it is different from the applied conductive magnetic metal, and for example, one or more metals, different from the conductive magnetic metal, of copper, phosphorus, molybdenum, zinc, manganese, chromium, indium, tin, silver, platinum, gold, aluminum or magnesium, and the like may be applied, without being limited thereto.

The ratio of the conductive magnetic metal in the metal component is not particularly limited. For example, the ratio may be adjusted so that the ratio may generate an appropriate Joule heat upon application of the induction heating method to be described below. For example, the metal component may comprise 30 wt % or more of the conductive magnetic metal based on the weight of the total metal component. In another example, the ratio of the conductive magnetic metal in the metal component may be about 35 wt % or more, about 40 wt % or more, about 45 wt % or more, about 50 wt % or more, about 55 wt % or more, 60 wt % or more, 65 wt % or more, 70 wt % or more, 75 wt % or more, 80 wt % or more, 85 wt % or more, or 90 wt % or more. The upper limit of the conductive magnetic metal ratio is not particularly limited, and may be, for example, less than about 100 wt %, or 95 wt % or less. However, the above ratios are exemplary ratios. For example, since the heat generated by induction heating due to application of an electromagnetic field can be adjusted according to the strength of the electromagnetic field applied, the electrical conductivity and resistance of the metal, and the like, the ratio can be changed depending on specific conditions.

The metal component forming the green structure may be in the form of powder. For example, the metals in the metal component may have an average particle diameter in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the metal in the metal component, one having different average particle diameters may also be applied. The average particle diameter can be selected from an appropriate range in consideration of the shape of the desired metal foam, for example, the thickness or porosity of the metal foam, and the like, which is not particularly limited.

The green structure may be formed using a slurry comprising first and second solvents together with the metal component comprising the metal.

As the first and second solvents, those having different dielectric constants can be applied. In one example, as the first solvent, one having a dielectric constant of 20 or more may be used, and as the second solvent, one having a dielectric constant of 15 or less may be used. In this specification, the dielectric constant may be a dielectric constant measured at any one temperature in a range of about 20° C. to 25° C. If two kinds of solvents having different dielectric constants are mixed and used, it is possible to form an emulsion, whereby a pore structure can be formed by this emulsion.

In order to increase formation efficiency of the pore structure, the first and second solvents may be selected so that a ratio (D1/D2) of a dielectric constant (D1) of the first solvent to a dielectric constant (D2) of the second solvent is in a range of 5 to 100. In another example, the ratio (D1/D2) may be about 90 or less, about 80 or less, about 70 or less, about 60 or less, or about 50 or less.

The specific dielectric constant range of the first solvent and the second solvent is not particularly limited as long as it satisfies the above content.

In one example, the dielectric constant of the first solvent may be in the range of 20 to 100. In another example, the dielectric constant of the first solvent may be about 25 or more, or about 30 or more. Also, in another example, the dielectric constant of the first solvent may be about 95 or less, about 90 or less, or about 85 or less.

Such a first solvent may be exemplified by, for example, water, an alcohol such as a monohydric alcohol having 1 to 20 carbon atoms, acetone, N-methylpyrrolidone, N,N-dimethylformamide, acetonitrile, dimethylacetamide, dimethyl sulfoxide or propylene carbonate, and the like, but is not limited thereto.

The dielectric constant of the second solvent may be in the range of, for example, 1 to 15. In another example, the dielectric constant of the second solvent may be about 13 or less, about 11 or less, about 9 or less, about 7 or less, or about 5 or less.

Such a second solvent may be exemplified by an alkane having 1 to 20 carbon atoms, an alkyl ether having an alkyl group having 1 to 20 carbon atoms, pyridine, ethylene dichloride, dichlorobenzene, trifluoroacetic acid, tetrahydrofuran, chlorobenzene, chloroform or toluene, and the like, but is not limited thereto.

The ratio of each component in the slurry as above may be appropriately adjusted, which is not particularly limited.

For example, the metal component in the slurry may have a ratio in a range of 100 to 300 parts by weight relative to 100 parts by weight of the total weight of the first and second solvents. In another example, the ratio may be about 290 parts by weight or less, about 250 parts by weight or less, about 200 parts by weight or less, about 150 parts by weight or less, or about 120 parts by weight or less, and in another example, it may be about 110 parts by weight or more, or about 120 parts by weigh or more.

In addition, the ratio of the first and second solvents in the slurry may be adjusted so that relative to 100 parts by weight of any one solvent of the first and second solvents, the part by weight of the other solvent is in a range of about 0.5 to 10 parts by weight. In another example, the ratio may be about 9 parts by weight or less, about 8 parts by weight or less, about 7 parts by weight or less, about 6 parts by weight or less, about 5 parts by weight or less, about 4 parts by weight or less, or about 3 parts by weight or less, and in one example, it may be about 1 part by weight or more, about 1.5 parts by weight or more, or about 2 parts by weight or more. For example, the weight ratio of the second solvent, relative to 100 parts by weight of the first solvent in the slurry, may be within the above range, or the weight ratio of the first solvent, relative to 100 parts by weight of the second solvent, may be within the above range.

The slurry may further comprise a binder, if necessary. The kind of the binder is not particularly limited, and may be appropriately selected depending on the kind of the metal component or the solvents, and the like applied at the time of producing the slurry. For example, the binder may be exemplified by alkyl cellulose having an alkyl group having 1 to 8 carbon atoms such as methyl cellulose or ethyl cellulose, polyalkylene carbonate having an alkylene unit having 1 to 8 carbon atoms such as polypropylene carbonate or polyethylene carbonate, or a polyvinyl alcohol-based binder such as polyvinyl alcohol or polyvinyl acetate, and the like, but is not limited thereto.

For example, in the slurry, the binder may be included at a ratio of about 10 to 500 parts by weight relative to 100 parts by weight of the above-described metal component. In another example, the ratio may be about 450 parts by weight or less, about 400 parts by weight or less, about 350 parts by weight or less, about 300 parts by weight or less, about 250 parts by weight or less, about 200 parts by weight or less, about 150 parts by weight or less, about 100 Parts by weight or less, or about 50 parts by weight or less.

The slurry may also comprise, in addition to the above-mentioned components, known additives which are additionally required.

The method of forming the green structure using the slurry as above is not particularly limited. In the field of manufacturing metal foams, various methods for forming the green structure are known, and in the present application all of these methods can be applied. For example, the green structure may be formed by holding the slurry in an appropriate template, or by coating the slurry in an appropriate manner.

The shape of such a green structure is not particularly limited as it is determined depending on the desired metal foam. In one example, the green structure may be in the form of a film or sheet. For example, when the structure is in the form of a film or sheet, the thickness may be 5,000 μm or less, 3,500 μm or less, 2,000 μm or less, 1000 μm or less, 800 μm or less, 700 μm or less, or 500 μm or less. Metal foams have generally brittle characteristics due to their porous structural features, so that there are problems that they are difficult to be manufactured in the form of films or sheets, particularly thin films or sheets, and are easily broken even when they are made. However, according to the method of the present application, it is possible to form a metal foam having pores uniformly formed inside and excellent mechanical properties as well as a thin thickness.

The lower limit of the structure thickness is not particularly limited. For example, the film or sheet shaped structure may have a thickness of about 10 μm or more, 50 μm or more, or about 100 μm or more.

The metal foam can be manufactured by sintering the green structure formed in the above manner. In this case, a method of performing the sintering for producing the metal foam is not particularly limited, and a known sintering method can be applied. That is, the sintering can proceed by a method of applying an appropriate amount of heat to the green structure in an appropriate manner.

As a method different from the existing known method, in the present application, the sintering can be performed by an induction heating method. That is, as described above, the metal component comprises the conductive magnetic metal having the predetermined magnetic permeability and conductivity, and thus the induction heating method can be applied. By such a method, it is possible to smoothly manufacture metal foams having excellent mechanical properties and whose porosity is controlled to the desired level as well as comprising uniformly formed pores.

Here, the induction heating is a phenomenon in which heat is generated from a specific metal when an electromagnetic field is applied. For example, if an electromagnetic field is applied to a metal having a proper conductivity and magnetic permeability, eddy currents are generated in the metal, and Joule heating occurs due to the resistance of the metal. In the present application, a sintering process through such a phenomenon can be performed. In the present application, the sintering of the metal foam can be performed in a short time by applying such a method, thereby ensuring the processability, and at the same time, the metal foam having excellent mechanical strength as well as being in the form of a thin film having a high porosity can be produced.

Thus, the sintering process may comprise a step of applying an electromagnetic field to the green structure. By the application of the electromagnetic field, Joule heat is generated by the induction heating phenomenon in the conductive magnetic metal of the metal component, whereby the structure can be sintered. At this time, the conditions for applying the electromagnetic field are not particularly limited as they are determined depending on the kind and ratio of the conductive magnetic metal in the green structure, and the like. For example, the induction heating can be performed using an induction heater formed in the form of a coil or the like. In addition, the induction heating can be performed, for example, by applying a current of 100 A to 1,000 A or so. In another example, the applied current may have a magnitude of 900 A or less, 800 A or less, 700 A or less, 600 A or less, 500 A or less, or 400 A or less. In another example, the current may have a magnitude of about 150 A or more, about 200 A or more, or about 250 A or more.

The induction heating can be performed, for example, at a frequency of about 100 kHz to 1,000 kHz. In another example, the frequency may be 900 kHz or less, 800 kHz or less, 700 kHz or less, 600 kHz or less, 500 kHz or less, or 450 kHz or less. In another example, the frequency may be about 150 kHz or more, about 200 kHz or more, or about 250 kHz or more.

The application of the electromagnetic field for the induction heating can be performed within a range of, for example, about 1 minute to 10 hours. In another example, the application time may be about 9 hours or less, about 8 hours or less, about 7 hours or less, about 6 hours or less, about 5 hours or less, about 4 hours or less, about 3 hours or less, about 2 hours or less, about 1 hour or less, or about 30 minutes or less.

The above-mentioned induction heating conditions, for example, the applied current, the frequency and the application time, and the like may be changed in consideration of the kind and the ratio of the conductive magnetic metal, as described above.

The sintering of the green structure may be carried out only by the above-mentioned induction heating, or may also be carried out by applying an appropriate heat, together with the induction heating, that is, the application of the electromagnetic field, if necessary.

The present application also relates to a metal foam. The metal foam may be one manufactured by the above-mentioned method. Such a metal foam may comprise, for example, at least the above-described conductive magnetic metal. The metal foam may comprise, on the basis of weight, 30 wt % or more, 35 wt % or more, 40 wt % or more, 45 wt % or more, or 50 wt % or more of the conductive magnetic metal. In another example, the ratio of the conductive magnetic metal in the metal foam may be about 55 wt % or more, 60 wt % or more, 65 wt % or more, 70 wt % or more, 75 wt % or more, 80 wt % or more, 85 wt % or more, or 90 wt % or more. The upper limit of the ratio of the conductive magnetic metal is not particularly limited, and may be, for example, less than about 100 wt % or 95 wt % or less.

The metal foam may have a porosity in a range of about 40% to 99%. As mentioned above, according to the method of the present application, porosity and mechanical strength can be controlled, while comprising uniformly formed pores. The porosity may be 50% or more, 60% or more, 70% or more, 75% or more, or 80% or more, or may be 95% or less, or 90% or less.

The metal foam may also be present in the form of thin films or sheets. In one example, the metal foam may be in the form of a film or sheet. The metal foam of such a film or sheet form may have a thickness of 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. For example, the film or sheet shaped metal foam may have a thickness of about 10 μm or more, about 20 μm or more, about 30 μm or more, about 40 μm or more, about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more.

Such metal foams can be utilized in various applications where a porous metal structure is required. In particular, according to the method of the present application, it is possible to manufacture a thin film or sheet shaped metal foam having excellent mechanical strength as well as the desired level of porosity, as described above, thus expanding applications of the metal foam as compared to the conventional metal foam.

Advantageous Effects

The present application can provide a method for manufacturing a metal foam, which is capable of forming a metal foam comprising uniformly formed pores and having excellent mechanical properties as well as the desired porosity, and a metal foam having the above characteristics. In addition, the present application can provide a method capable of forming a metal foam in which the above-mentioned physical properties are ensured, while being in the form of a thin film or sheet, and such a metal foam.

BRIEF DESCRIPTION OF DRAWINGS

FIG. 1 is an SEM photograph of the produced sheet in Example 1,

FIG. 2 is an SEM photograph of the produced sheet in Example 2, and

FIG. 3 is an SEM photograph of the produced sheet in Example 3.

MODE FOR INVENTION

Hereinafter, the present application will be described in detail by way of examples and comparative examples, but the scope of the present application is not limited to the following examples.

Example 1

Methyl cellulose and hydropropyl methyl cellulose as polymeric binders are mixed with 35.0 g of water (dielectric constant at 20° C.: about 80) as a first solvent in amounts of 1.9 g and 3.6 g, respectively, stirred and dissolved. After the dissolution is completed, 54.0 g of nickel powder (having conductivity of about 14.5 MS/m, relative magnetic permeability of about 600 and average particle diameter of about 10 to 20 μm), 2.7 g of a surfactant and 2.0 g of ethylene glycol are sequentially added and stirred. Thereafter, 0.8 g of pentane (dielectric constant at 20° C.: about 1.84) to be used as a foaming agent is added and stirred.

The sample prepared through the above process is bar-coated on a silicon nitride plate to a thickness of 0.5 mm, heated to 40° C. in a space having a humidity of 80% or more and foamed for 10 minutes. Thereafter, it was heated at 80° C. under a humidity of 60% or less for 30 minutes and the solvent was dried to form a green structure (film). An electromagnetic field was then applied to the green structure with a coil-type induction heater while purging with hydrogen/argon gas to form a reducing atmosphere. The electromagnetic field was formed by applying a current of about 350 A at a frequency of about 380 kHz, and the electromagnetic field was applied for about 3 minutes. After the application of the electromagnetic field, the sintered green structure was cleaned to produce a sheet having a thickness of about 1.5 mm in the form of a film. The produced sheet had a porosity of about 91%. FIG. 1 is an SEM photograph of the produced sheet.

Example 2

A sheet having a thickness of about 1.7 mm was produced in the same manner as in Example 1, except that as the second solvent, hexane (dielectric constant at 20° C.: about 1.88) was used instead of pentane. The produced sheet had a porosity of about 94%. FIG. 2 is an SEM photograph of the produced sheet.

Example 3

A sheet having a thickness of about 0.7 mm was produced in the same manner as in Example 2, except that as the first solvent, NMP (N-Methylpyrrolidone) (dielectric constant at 25° C.: about 32.2) was used instead of water. The produced sheet had a porosity of about 62%. FIG. 3 is an SEM photograph of the produced sheet.

Example 4

A sheet having a thickness of about 1.1 mm was produced in the same manner as in Example 2, except that as the second solvent, ethyl ether (dielectric constant at 20° C.: about 4.33) was used instead of pentane. The produced sheet had a porosity of about 81%.

Comparative Example 1

A sheet was produced in the same manner as in Example 1, except that the second solvent was not applied and the weight ratio (W:MC) of water (W) to methyl cellulose (MC) was 95:5. The produced sheet was very brittle and easily broken, and thus the tensile strength could not be measured, and the pores were also formed very non-uniformly.

Comparative Example 2

A sheet was produced in the same manner as in Example 3, except that the second solvent was not applied and the weight ratio (NMP:MC) of NMP and methyl cellulose (MC) was 95:5. The produced sheet was very brittle and easily broken, and thus the tensile strength could not be measured, and the pores were also formed very non-uniformly.

What is claimed is:

1. A method for manufacturing a metal foam, the method comprising:

forming a green structure using a slurry comprising a metal component comprising a conductive metal with relative magnetic permeability of 90 or more, a first solvent having a first dielectric constant of 20 or more, and a second solvent having a second dielectric constant of 15 or less; and sintering the green structure by applying an electromagnetic field to the green structure to produce a sintered product of the metal component, wherein the sintering of the green structure is only performed by induction heating, wherein the slurry comprises 100 to 250 parts by weight of the metal component relative to 100 parts by weight of a total weight of the first and second solvents, wherein the slurry comprises 1 to 6 parts by weight of the second solvent relative to 100 parts by weight of the first solvent, wherein the electromagnetic field is applied with a coil-type induction heater, and wherein the electromagnetic field is applied by applying a current in a range of 100 A to 1,000 A at a frequency in a range of 100 kHz to 1,000 kHz.

2. The method for manufacturing a metal foam according to claim 1, wherein the conductive metal has a conductivity of 8 MS/m or more at 20° C.

3. The method for manufacturing a metal foam according to claim 1, wherein the conductive metal is nickel, iron or cobalt.

4. The method for manufacturing a metal foam according to claim 1, wherein the metal component comprises 30 wt % or more of the conductive metal.

5. The method for manufacturing a metal foam according to claim 1, wherein the conductive metal has an average particle diameter in a range of 10 to 100 μm.

6. The method for manufacturing a metal foam according to claim 1, wherein a ratio of the first dielectric constant of the first solvent to the second dielectric constant of the second solvent is in a range of 5 to 100.

7. The method for manufacturing a metal foam according to claim 1, wherein the first dielectric constant of the first solvent is in a range of 20 to 100.

8. The method for manufacturing a metal foam according to claim 1, wherein the first solvent is water, an alcohol, acetone, N-methylpyrrolidine, N,N-dimethylformamide, acetonitrile, dimethylacetamide, dimethyl sulfoxide or propylene carbonate.

9. The method for manufacturing a metal foam according to claim 1, wherein the second dielectric constant of the second solvent is in a range of 1 to 15.

10. The method for manufacturing a metal foam according to claim 1, wherein the second solvent is an alkane, an alkyl ether, pyridine, ethylene dichloride, dichlorobenzene, trifluoroacetic acid, tetrahydrofuran, chlorobenzene, chloroform or toluene.

11. The method for manufacturing a metal foam according to claim 1, wherein the slurry comprises 110 to 200 parts by weight of the metal component relative to 100 parts by weight of a total weight of the first and second solvents.

12. The method for manufacturing a metal foam according to claim 1, wherein the slurry comprises 1.5 to 5 parts by weight of the second solvent relative to 100 parts by weight of the first solvent.

13. The method for manufacturing a metal foam according to claim 1, wherein the slurry further comprises a binder.

14. The method for manufacturing a metal foam according to claim 1, wherein applying the electromagnetic field comprises applying a current in a range of 150 A to 900 A.

15. The method for manufacturing a metal foam according to claim 1, wherein applying the electromagnetic field comprises applying a current having a frequency in a range of 150 kHz to 900 kHz.

16. The method for manufacturing a metal foam according to claim 1, wherein the electromagnetic field is applied for a time in a range of 1 minute to 10 hours.

17. The method for manufacturing a metal foam according to claim 1, wherein the metal foam is in the form of a film or sheet.

18. The method for manufacturing a metal foam according to claim 17, wherein the film or sheet has a thickness of 5,000 μm or less.

19. The method for manufacturing a metal foam according to claim 1, wherein the first solvent is water or N-Methylpyrrolidone, and wherein the second solvent is pentane, hexane, or ethyl ether.

20. The method for manufacturing a metal foam according to claim 1 further comprising, before sintering the green structure:

coating the slurry onto a substrate;

heating the slurry to a first temperature in a space with a humidity of 80% or more to foam the slurry; and then heating the foamed slurry to a second temperature in a space with a humidity of 60% or less to dry the slurry and form the green structure.

* * * * *